United States Patent [19]

Horn, Jr.

[11] Patent Number: 4,737,071

[45] Date of Patent: Apr. 12, 1988

[54] VARIABLE GEOMETRY CENTRIFUGAL COMPRESSOR DIFFUSER

[75] Inventor: Raymond A. Horn, Jr., Milford, Mich.

[73] Assignee: Williams International Corporation, Walled Lake, Mich.

[21] Appl. No.: 309

[22] Filed: Jan. 5, 1987

Related U.S. Application Data

[63] Continuation of Ser. No. 725,553, Apr. 22, 1985, abandoned.

[51] Int. Cl.[4] ..... F01D 9/00

[52] U.S. Cl. ..... 415/148; 239/456; 415/46; 415/161; 415/209

[58] Field of Search ..... 239/289, 437–441, 239/451, 456–460; 415/148, 159, 166, 161, 46, 209

[56] References Cited

U.S. PATENT DOCUMENTS

| | | | |
|---|---|---|---|
| 352,229 | 11/1886 | Crowell | 415/159 |
| 917,970 | 4/1909 | Smith et al. | 415/166 |
| 2,648,195 | 8/1953 | Wilde et al. | 415/161 |
| 3,243,159 | 3/1966 | Hefler et al. | 415/166 |
| 3,495,921 | 2/1970 | Swearingen | 415/163 |
| 3,841,789 | 10/1974 | Corrigan et al. | 415/148 |
| 4,338,063 | 7/1982 | Nakanishi | 415/164 |
| 4,497,171 | 2/1985 | Corrigan et al. | 415/159 |
| 4,504,190 | 3/1985 | Beeloo | 415/166 |

FOREIGN PATENT DOCUMENTS

| | | | |
|---|---|---|---|
| 91931 | 8/1896 | Fed. Rep. of Germany | 415/166 |

*Primary Examiner*—Andres Kashnikow
*Assistant Examiner*—Michael J. Forman
*Attorney, Agent, or Firm*—Lyman R. Lyon

[57] ABSTRACT

A variable geometry centrifugal compressor diffuser or radial inflow turbine nozzle comprises a plurality of fixed radially extending pressure surface vane segments disposed in a circumferentially spaced array and a plurality of radially movable vane segments abutting said fixed segments for varying the geometry of said diffuser or nozzle.

1 Claim, 1 Drawing Sheet

VARIABLE GEOMETRY CENTRIFUGAL COMPRESSOR DIFFUSER

This is a continuation of co-pending application Ser. No. 725,553 filed on Apr. 22, 1985 now abandoned.

BACKGROUND OF THE INVENTION

Many engine installations require the use of a centrifugal compressor having an artifically extendable range. In particular, automotive engine applications exhibit cycle requirements demanding a "small" compressor at low speeds for good specific fuel consumption but a "large" compressor at full speed to meet peak power objectives. While it is known to use variable geometry diffusers to extend compressor range, such diffusers generally comprise multiple vanes that rotate between parallel endwalls to achieve throat area variations.

SUMMARY OF THE INVENTION

The instant invention relates to a variable geometry diffuser or nozzle. Each diffuser vane consists of a fixed pressure surface island and a movable suction surface island. The interface between the fixed and movable island elminates leakage between the pressure to suction surfaces of the diffuser while retaining the desired balance between diffuser throat area and effective inlet angle. The foregoing has heretofore been achieved only in units where the entire vane assembly rotates and consequently leaks.

In addition, the diffuser geometry of the instant invention permits the use of suction surface boundary layer control techniques that improve diffuser performance. The concept can be extended to radial in-flow turbine nozzle control thereby complementing the variable geometry compressor configuration.

DETAILED DESCRIPTION OF THE PREFERRED EMBODIMENT OF THE INVENTION

Figure 1:
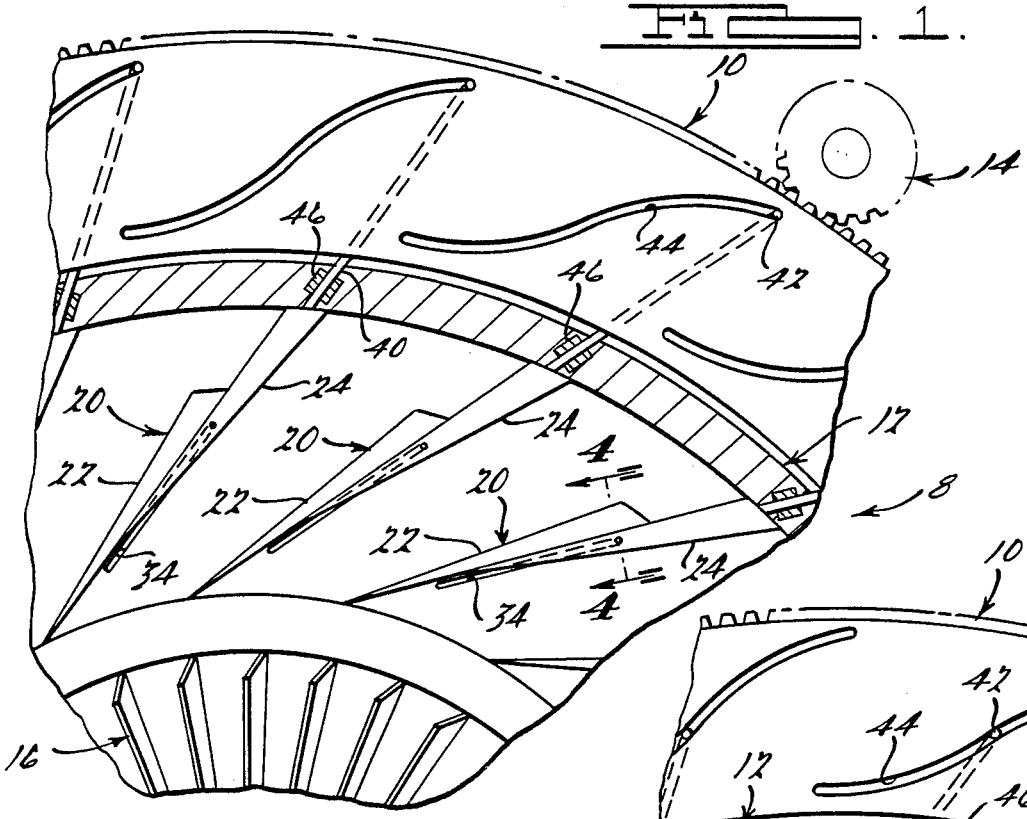
FIG. 1 is a fragmentary view of a compressor diffuser having the variable geometry vanes of the instant invention in the maximum radially outwardly extended condition.

As seen in FIG. 1, a diffuser or nozzle assembly 8 comprises a ring gear 10 mounted for rotation on a housing 12. The ring gear 10 is driven circumferentially of the housing 12 by a spur gear 14. Rotation of the spur gear 14 and consequent rotation of the ring gear 10 effects control of the vane geometry of the diffuser 8. A conventional compressor wheel 16 is disposed radially inwardly of a plurality of vanes 20.

Figure 4:
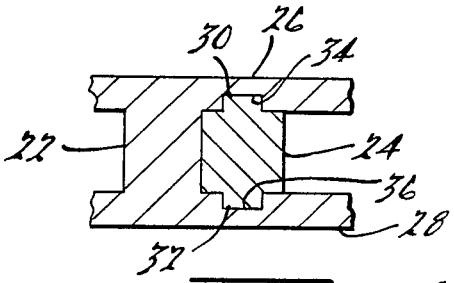
FIG. 4 is a view taken along the line 4—4 of FIG. 1.

In accordance with one feature of the present invention, each of a plurality of like diffuser or nozzle vanes 20 comprises a fixed island or segment 22 and a movable island or segment 24. The fixed segment 22 is a pressure surface segment and it is preferably integral with or bonded to the diffuser endwalls 26 and 28 (see FIG. 4). The movable segment 24 is a suction surface segment and it is provided with oppositely directed guide pins 30 and 32 which slide in tracks 34 and 36 cut into the diffuser endwalls 26 and 28, respectively. The permanent position of the pressure surface segments 22 minimizes endwall leakage effects.

Radial movement of the suction surface segment 24 of each vane 20 is controlled by a linkage rod 40 having a pin 42 which slides in a desmodromic track 44 cut into the rotatable ring gear 10. A combination seal and bearing 46 supports each rod 40.

Figure 2:
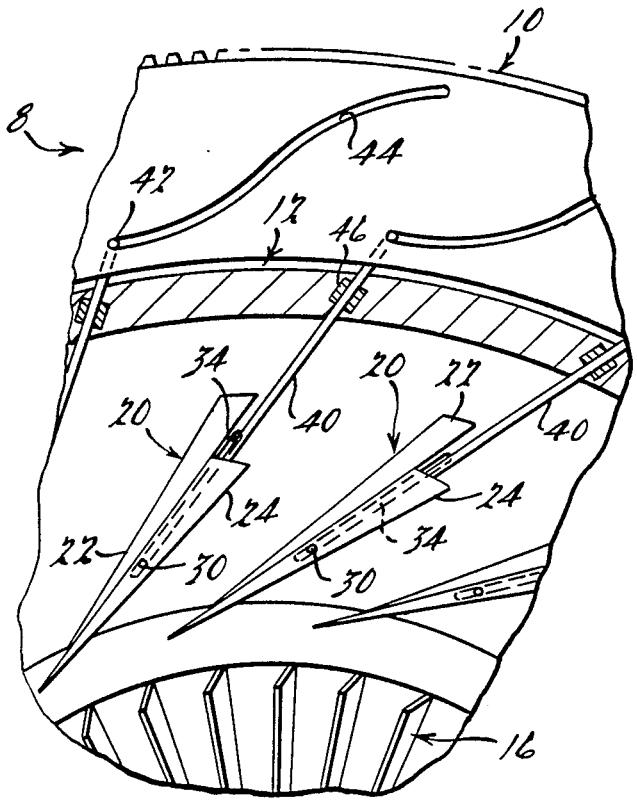
FIG. 2 is a view similar to FIG. 1 with the vanes in the maximum radially inwardly extended condition.
Figure 3:
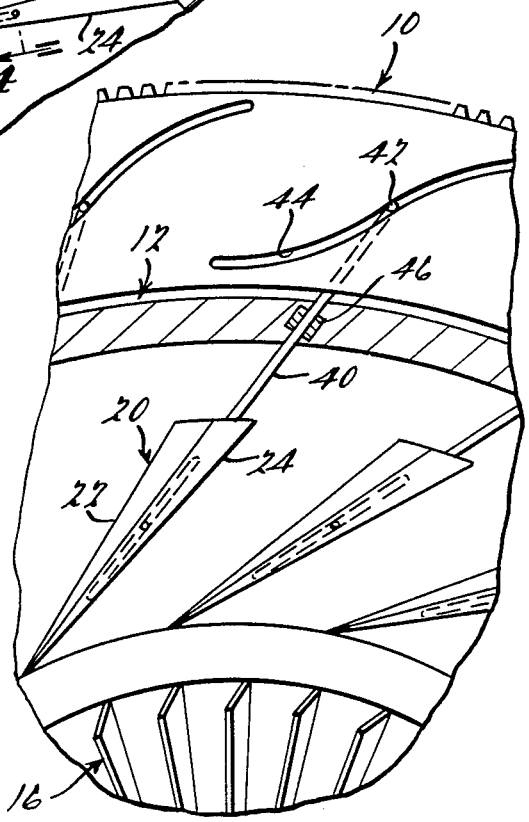
FIG. 3 is a view similar to FIG. 1 with the vanes in an intermediate extension position.

As best seen by comparing FIGS. 1–3, throat area variation is a function of the distance each suction surface segment 24 slides in its tracks 34 and 36, and the shape of the segment 24. It is obvious that vane segments 24 with curved surfaces and curved vane tracks can be used. The linkage connecting the vane segments 24 to the ring gear 10 can be a single piece (for straight line travel) or articulated to permit travel along curved tracks. Alternately, the linkage can be flexible.

From the foregoing it should be apparent that throat area variation for a centrifugal compressor diffuser or radial inflow turbine nozzle is attainable with very low leakage losses. The problems attendant to the use of vanes that rotate between parallel end walls and high levels of suction to pressure surface leakage which severely limit compressor or turbine efficiency are eliminated.

While the preferred embodiment of the invention has been disclosed, it should be appreciated that the invention is susceptible of modification without departing from the scope of the following claims.

I claim:

1. A variable geometry centrifugal compressor diffuser comprising a housing having spaced parallel walls extending laterally of a central axis, a plurality of fixed radially and circumferentially extending relatively thin vane segments disposed in a circumferentially spaced array in sealed relation to said walls, the circumferential spacing between a radially inner extremity of each of said fixed segments defining a fixed throat area, a plurality of radially and circumferentially movable vane segments of relatively thin radially outwardly divergent wedge-shaped radial cross section abutting said fixed segments, respectively, each of said movable vane segments having a radially inner extremity movable between a first position radially inwardly of the radially inward extremity of said fixed vane segments and a second position radially outwardly of the inner extremity of said fixed vane segments, a movable throat area between a radially inward extremity of each of said fixed vane segments and an opposed circumferentially, spaced movable vane segment being less than said fixed throat area when said movable segments are in said first position and equal to said fixed throat area when said movable segments are in said second position, an inlet angle between the adjacent fixed or movable vane segments being relatively constant at all positions of said movable vane segments whereby diffuser throat area is variable substantially independently of inlet angle.

* * * * *